US009260915B2

(12) United States Patent
Tyrode

(10) Patent No.: US 9,260,915 B2
(45) Date of Patent: Feb. 16, 2016

(54) DEVICE FOR CONTROLLING A RELEASE MEMBER FOR RELEASING AN ELECTRICAL ACTUATOR

(75) Inventor: Jerome Tyrode, Marnay (FR)

(73) Assignee: SIMU, Gray (FR)

( * ) Notice: Subject to any disclaimer, the term of this patent is extended or adjusted under 35 U.S.C. 154(b) by 1864 days.

(21) Appl. No.: 11/878,071

(22) Filed: Jul. 20, 2007

(65) Prior Publication Data

US 2008/0017330 A1 Jan. 24, 2008

(30) Foreign Application Priority Data

Jul. 21, 2006 (FR) ..... 06 06704

(51) Int. Cl.
*E05F 15/20* (2006.01)
*E06B 9/68* (2006.01)

(52) U.S. Cl.
CPC ..... *E06B 9/68* (2013.01)

(58) Field of Classification Search
CPC .. B62L 3/02; A63C 17/14; A63C 2017/1472; F16C 1/10; E06B 9/68; E06B 9/82; E06B 9/74; Y10T 16/44; Y10T 16/4724
USPC ..... 160/9, 310; 16/422, 430, 428; 74/501.6, 74/502, 502.2
See application file for complete search history.

(56) References Cited

U.S. PATENT DOCUMENTS 2,472,442 A * 6/1949 Schueler ..... 74/489
3,577,798 A * 5/1971 Guettier ..... 74/503
4,076,266 A * 2/1978 Krausz ..... 280/87.042
4,850,418 A 7/1989 Bresson
5,447,477 A 9/1995 Bresson et al.
5,464,235 A * 11/1995 Goldman et al. ..... 280/11.212
5,664,461 A * 9/1997 Kitamura ..... 74/502.4
6,170,122 B1 * 1/2001 Kuo ..... 16/405
6,325,134 B1 * 12/2001 Mullet ..... 160/189
7,231,953 B2 * 6/2007 Varley et al. ..... 160/273.1

FOREIGN PATENT DOCUMENTS

| | | |
|---|---|---|
| EP | 0 597 780 | 5/1994 |
| FR | 2 647 152 | 11/1990 |
| WO | 00/05720 | 8/2000 |

OTHER PUBLICATIONS

Jamar Hydraulic Hand Dynamometer Owners Manual, Accessed from https://content.pattersonmedical.com/PDF/spr/Product/288115.pdf on Mar. 25, 2015.*

* cited by examiner

*Primary Examiner* — Jeremy Ramsey
(74) *Attorney, Agent, or Firm* — Dowell & Dowell, PC

(57) ABSTRACT

This actuator device (1) is for actuating a release member for a motor and gearbox unit for applying rotary drive to a tube for winding a closure or solar protection screen. The release member is controlled by means of a cable. The device comprises a tensioner mechanism (20, 30) for tensioning the cable (11) in an actuation direction (Fa, Fa'), at least one locking means for locking the tensioner mechanism, and at least one unlocking means (41*a*) for unlocking the tensioner mechanism. The unlocking means are actuatable in a direction substantially perpendicular to the actuation direction.

19 Claims, 2 Drawing Sheets

Fig. 1

DEVICE FOR CONTROLLING A RELEASE MEMBER FOR RELEASING AN ELECTRICAL ACTUATOR

BACKGROUND OF THE INVENTION

1. Field of the Invention

The invention relates to a device for actuating a release member for a motor and gearbox unit that applies rotary-drive to a tube for winding a closure or solar protection screen. The invention also relates to a closure or solar protection installation including such a device.

The term closure installation is used to cover doors, gates, shutters, and equivalent pieces of equipment.

2. Brief Description of the Related Art

In this kind of installation, it is known to use an electric motor to rotate a tube for winding a panel that constitutes a door or a shutter or a solar protection blind. It is also known, e.g. from EP-A-0 597 780, to provide a drive release member so as to enable operation to be performed manually, in particular for safety reasons, to allow maintenance to be carried out on the installation, or in the event of an electrical power failure. The release member is controlled by a sheathed cable connected to an actuator device. With the help of an actuator device, the user acts on the tension of the cable and thus on the member for releasing the motor and gearbox unit, thereby enabling the motor to be uncoupled from the above-mentioned winding tube.

One such actuator device is described in FR-A-2 647 152. In that application, a release lever is secured to one-fourth of a toothed wheel having the release cable attached thereto. The tension in the cable is then proportional to the extent to which the toothed wheel portion is turned. To turn said portion, the lever is tilted in an operating direction perpendicular to the axis of the wheel. That device also includes a mechanism for locking the toothed wheel. A catch is received in one of the teeth of the wheel. When the wheel is turned through one tooth, the catch disengages from the tooth with which it was engaged and engages in the following tooth. The device is again locked. To unlock it, the user needs to act on a second lever in a direction that is colinear with the previous operating direction. That action has the effect of disengaging the catch from the toothed wheel which then becomes a "free wheel". Because the actuation directions for locking and unlocking are colinear, there is a major risk of involuntarily action being taken. This risk increases if it is desired to make the device more compact than the device described. It has been found advantageous, in use, and for better control over the force exerted on the cable, for the device to be more compact, ergonomic, and suitable for being gripped firmly in one hand. The solution described in FR-A-2 647 152 also implies locking means that are distinct from the control lever, which is not favorable to reducing overall size.

SUMMARY OF THE INVENTION

To mitigate the problems described above, the invention proposes a compact and ergonomic device that ensures safe unlocking of the mechanism for applying tension to the release cable.

To this end, the invention relates to an actuator device for actuating a release member for a motor and gearbox unit for applying rotary drive to a tube for winding a closure or solar protection screen, the release member being controlled by means of a cable. The actuator device comprises a tensioner mechanism for tensioning the cable in an actuation direction, at least one locking means for locking the tensioner mechanism, and at least one unlocking means for unlocking the tensioner mechanism. The unlocking means are actuatable in a direction substantially perpendicular to the actuation direction.

Thus, the invention eliminates the risk of actuating the unlocking means in untimely manner.

According to aspects of the invention that are advantageous but not essential, the device incorporates one or more of the following features:

The tensioner mechanism forms a deformable handle that can be held in one hand. An actuator device in the form of a handle serves to facilitate actuating the cable and to control the sensitivity of the operating force. It is important to be able to control the traction force exerted, since too great a force would run the risk of damaging the cable return mechanism. Ergonomic handle shapes, e.g. notch shapes, enable the handle to be held securely and force to be well controlled.

The tensioner mechanism comprises a first part to which the cable is fastened, and a second part to which a sheath of said cable is fastened, the two parts being mounted to be movable relative to each other. The locking means is then suitable for blocking the degree of freedom between the two moving parts. The movement of one part relative to the other thus delivers traction to the release cable and thereby acts on the release member. Furthermore, the blocking by the locking means ensures that the force on the cable is maintained and thus that the state of the release member is maintained.

The two parts are mounted to pivot relative to each other, the lever effect making it possible to obtain a long stroke in a contact unit.

The unlocking means comprise at least one tooth disposed on one of the moving parts of the tensioner mechanism and suitable for co-operating with a set of teeth disposed on the other moving part of the tensioner mechanism.

The unlocking means is disposed on one of the moving parts, thus making the device more compact.

At least one of the two parts of the tensioner mechanism includes means for marking the relative position between the two parts. This marking indicates the position of one moving part relative to the other, which amounts to giving an indication concerning the traction force exerted on the cable and thus about the state in which the release member is to be found.

The device includes two unlocking means, the two unlocking means being actuated simultaneously in order to obtain unlocking. This solution serves to increase the safety of unlocking against wrong operation: it is necessary to actuate both means simultaneously in order to obtain effective unlocking of the mechanism when under tension.

The two unlocking means act on the locking mechanism on either side of the actuation direction, so as to obtain a device that is compact.

The invention also provides a closure or solar protection installation that includes an actuator device of the type defined above.

BRIEF DESCRIPTION OF THE DRAWINGS

The invention can better understood on reading the following description given purely by way of example and made with reference to the accompanying drawings, in which.

DETAILED DESCRIPTION OF THE PREFERRED EMBODIMENT

Figure 1:
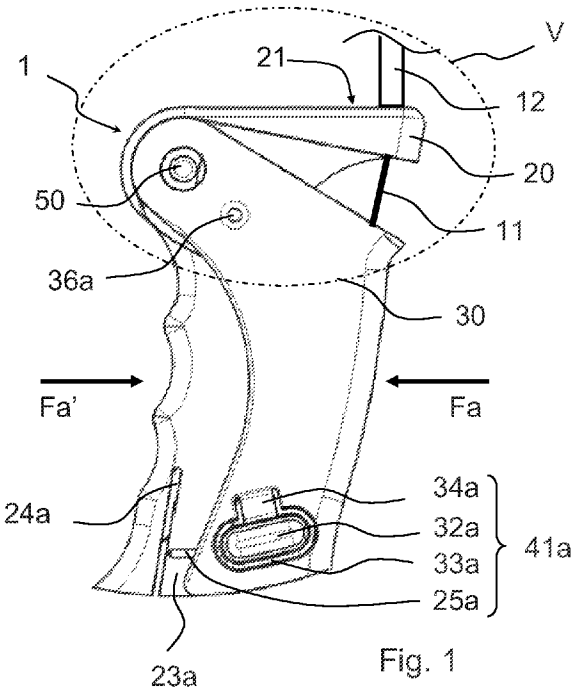
FIG. 1 is a face view of the actuator device of the invention, shown in the "released" position, the release member releasing the motor and gearbox unit.
Figure 3:
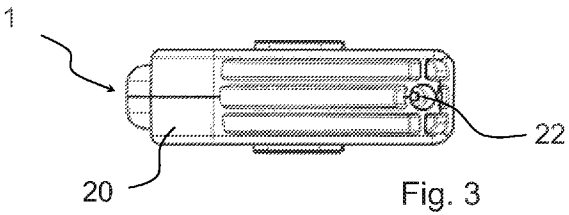
FIG. 3 is a plan view of the actuator device of the invention.
Figure 2:
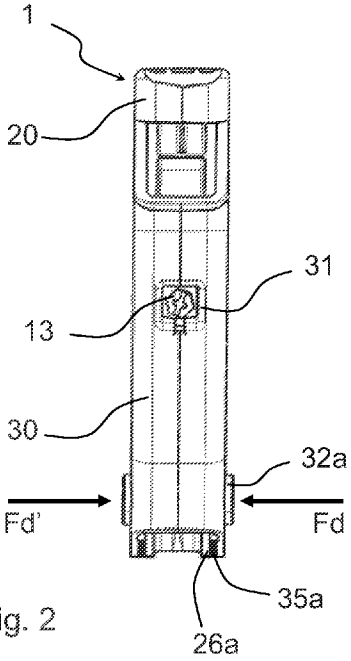
FIG. 2 is a view of the right side of the actuator device of the invention.

The actuator device shown in FIGS. 1 to 4 is for controlling a release member of the type described in EP-A-0 597 780, a brake control device of the type described in FR-A-2 612 246, or any other similar type of member.

Such a release member can be as follows: in a device for operating an installation for closing or providing protection against the sun that includes a winding tube rotated by a tubular motor supported by a base constrained to rotate with a toothed wheel, the release member comprises, for example, a blocking latch movable in translation between a first position in which the latch prevents rotation of the toothed wheel, and a second position in which the latch does not interact with the toothed wheel.

By pulling on an operating cable, a rod, or a strap, the blocking latch is moved in translation easily and intuitively, including in an emergency or panic situation.

For better operation, provision may also be made of a mechanism for resiliently returning the cable by repositioning the cable in a rest position when it is no longer under tension. Such devices are known and are often integrated in the release member.

The actuator device as shown in FIGS. 1 to 4 is in the form of a release handle 1 made up of two moving parts 20 and 30. The first moving part 20 is engaged in the second moving part 30. The second moving part 30 then covers part of the first moving part.

A cable 11 protected by a sheath 12 connects the release handle 1 to the release member (not shown). The cable 11 is mounted on the handle 1 by applying the following steps. The cable 11 is passed through an opening 22 in the first moving part 20, and then through an opening (not shown) in the second moving part 30. A cable clamp 13 is then fixed on the cable 11 in the desired position. In operation, the cable clamp 13 is completely housed in a cavity 31 formed in the second moving part 30. As a result, the handle 1 is ergonomic without any accessible sharp part. The sheath 12 comes to bear against a top face 21 of the first moving part 20. The two moving parts 20 and 30 can pivot relative to each other about a transverse pin 50. The transverse pin 50 is at a distance from the openings provided for passing the cable in the moving parts 20 and 30, thereby forming a lever arm. Consequently, when a hand is tightened over the two moving parts 20 and 30, substantially in directions Fa and Fa', these two parts pivot relative to each other and thus move apart the end of the sheath 12 and the cable clamp 13. This movement applies tension to the cable, and thus actuates the release member.

Because of the selected dimensions and an ergonomic shape, the handle 1 is easily manipulated in one hand and makes it possible to control the tension applied to the cable.

To increase the accuracy of control and to maintain a constant tension on the cable, locking means 40*a* are provided for locking the two moving parts 20 and 30 relative to each other. The locking means 40*a* comprise firstly a set of teeth 35*a* that are situated on an inside peripheral zone of the second moving part 30. The set of teeth 35*a* is generally in the form of a circular arc substantially centered on the pin 50.

The locking means 40*a* also comprises a tooth 26*a* secured to the first moving part 20. Naturally, an inverse disposition of the tooth 26*a* and the set of teeth 35*a* being on the second and first moving parts 30 and 20 could be envisaged.

The tooth 26*a* and the set of teeth 35*a* co-operate when the two moving parts overlap at least in part so as to block the two moving parts 20 and 30 relative to each other. This blocking serves to prevent the release cable 11 from returning to its equilibrium position.

The slopes of the inclined teeth in the set of teeth 35*a* and of the co-operating tooth 26*a* are thus implemented in such a manner as to facilitate the movement of tensioning the cable (the teeth of the set of teeth 35*a* present a sloping ramp profile in this direction), and to block the return movement towards the equilibrium position of the cable 11 (the teeth of the set of teeth 35*a* present a stop profile in this direction).

Furthermore, the bottom end of the first moving part 20 is also provided with a slot 24*a*. This slot 24*a* defines a tab 23*a* with a small amount of resilience, on which the tooth 26*a* is mounted. The resilience of the tab 23*a* depends on the size of the slot 24*a*.

This resilience determines the operating force and has an influence on the sensation perceived by the user when actuating the handle 1, on the release force, and possibly also on the audible sound that occurs on passing a tooth of the set of teeth. This audible effect contributes to the ergonomics of the device and to controlling the operating force.

Unlocking means 41*a* are provided for enabling the device to be released once it has become locked. The unlocking means 41*a* comprise an unlocking button 32*a* that can be moved in a direction Fd substantially perpendicular to the actuation direction Fa or Fa' of the device 1, i.e. in a direction that is substantially perpendicular to the operating direction for tensioning the cable. The term "substantially" should be understood as being plus or minus 20°.

The button 32*a* is inserted in an opening 33*a* of the second moving part 30. It is connected to the moving part 30 via a resilient tab 34*a*, thus enabling the button 32*a* to be moved relative to the second moving part 30 in the direction Fd. The second moving part 30, the button 32*a*, and the tab 34*a* can naturally be obtained as a single molded part.

When moved in the direction Fd, the button 32*a* encounters a linear projection 25*a* disposed on the tab 23*a*. The purpose of this linear projection 25*a* is to form a point of contact between the button 32*a* when it is actuated and the tab 23*a*, regardless of the position of the moving parts 20 and 30 relative to each other. If the actuation of the button 32*a* is continued in the direction Fd, then the tab 23*a* flexes, thereby releasing the tooth 26*a* from the set of teeth 35*a*. The device is then unlocked and the two moving parts 20 and 30 can return to a position in which the cable is in its equilibrium position.

The unlocking force thus depends on the resilience of the tab 23, as mentioned above. The position and the size of the projection 25*a*, and the dimensioning of the slot 24*a* are likewise parameters that have an influence on the unlocking force.

A preferred embodiment presents two locking means 40*a* and 40*b*, and two unlocking means 41*a* and 41*b*. The need to act simultaneously on both unlocking means 41*a* and 41*b* reinforces the safety of such a device against errors of manipulation.

Figure 4:
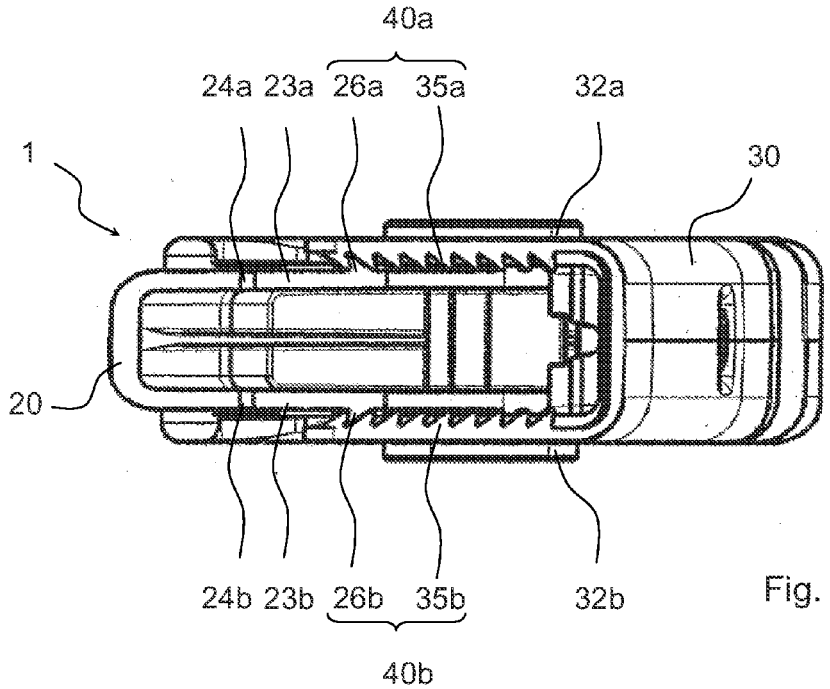
FIG. 4 is a view from beneath of the actuator device of the invention.
Figure 5:
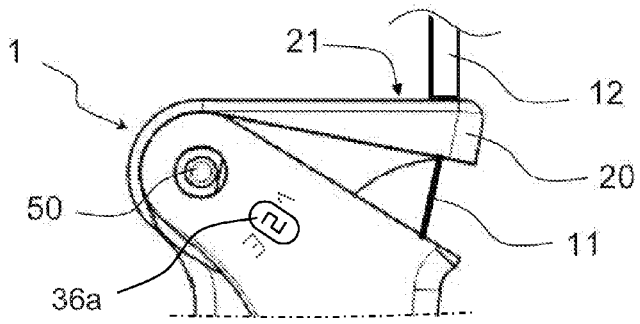
FIG. 5 is a face view of the area denoted as V in FIG. 1.

The second locking and unlocking means 40*b* and 41*b* may be made symmetrically relative to the plane that contains the actuation direction Fa. The handle thus has a second tab 23*b*, a second slot 24*b*, a second linear projection 25*b*, a second set of teeth 35*b*, a second tooth 26*b*, and also a second button 32*b*, as shown in FIG. 4.

Nevertheless, provision can be made for devices that have only one locking and/or unlocking means 40*a*, 41*a*.

The ergonomic shape of the handle 1, the dimensioning of the tab 23, in particular in terms of resilience/stiffness, and the optional audible effect of the locking means 40 all have an influence on the perception of the user while actuating the device of the invention, and thus on the user's control over the tension force in the cable.

An advantageous aspect of the invention also consists in monitoring the angular position between the two moving parts 20 and 30. To do this, marker means may be provided. The marker means may operate visually.

Thus, as shown in FIG. 1, the first moving part 20 has a plurality of patterns disposed on a circular arc substantially centered on the transverse pin 50. These patterns are masked by the second moving part 30 with the exception of one pattern that can be seen through an opening 36*a* provided for this purpose in the second moving part 30. When the device is actuated, the moving parts pivot relative to each other so the opening 36*a* of the second moving part 30 shifts relative to the first moving part 20, thus allowing a new pattern on said first moving part 20 to appear. Consequently, the pattern that is visible is a function of the angular position between the two moving parts. It is possible to use a green spot when the motor and gearbox unit is released and a red spot when it is engaged. Other marker means could be used, in particular an oblong opening 36*a* with marking in the form of a graduated scale on the first moving part 20. The same marker means could also be provided on the other side of the device.

In a variant, an additional locking mechanism may be provided to reinforce the safety of the device. This mechanism consists in blocking the degree of freedom between the two moving parts 20 and 30. The mechanism may be a pin (not shown) that is inserted in the opening 36*a* and that passes through both moving parts 20 and 30. The first moving part 20 then has at least two through holes, of axis substantially perpendicular to the actuation direction Fa, and disposed in such a manner that when the device is in the "engaged" or the "release" position (i.e. when the release member actuated by the device is in the corresponding state), one of the through hole axes lies on the axis of the hole constituting the opening 36*a*. Preferably, the second moving part 30 has two openings 36*a* and 36*b* on a common axis that are disposed symmetrically on either side of the first moving part 20. Thus, the additional locking is obtained when the pin passes through these two openings and the through hole.

The invention claimed is:

1. An actuator device for actuating a release member for a motor and gearbox unit for applying rotary drive to a tube for winding a closure or solar protection screen, the release member being controlled by a cable, the actuator device comprising a tensioner mechanism for tensioning the cable by an action on two relatively movable parts of the tensioner mechanism along a first actuation direction and wherein the two relatively movable parts of the tensioner mechanism form a deformable handle of a size and configuration to be operatively manipulated in a person's hand by being moved relative to one another along the first actuation direction in order to place tension on the cable in a direction different than the first actuation direction, at least one tooth cooperating with a set of teeth for locking the two relatively movable parts to one another to retain tension on the cable, and at least one button for unlocking the two relatively movable parts of the tensioner mechanism, wherein the button is mounted to one of the two relatively movable parts and is manually movable along a second actuation direction that is substantially perpendicular to the first actuation direction to thereby force the at least one tooth carried by one of the two relatively movable parts to be released from the set of teeth carried by the other of the two relatively movable parts and wherein one of the two relatively movable parts of the tensioner mechanism includes an opening and marks on the other of the two relatively movable parts viewable through the opening for identifying a relative position between the two relatively movable parts.

2. The device according to claim 1, wherein the two relatively movable parts of the tensioner mechanism are pivotally mounted to one another.

3. The device according to claim 1, wherein the cable is fastened to one of the two relatively movable parts, and a sheath of the cable bears against a second of the two relatively movable parts, and the at least one tooth cooperating with the set of teeth blocks a degree of freedom of movement between the two relatively movable parts.

4. The device according to claim 3, wherein the two relatively movable parts are pivotally mounted to one another.

5. The device according to claim 3, wherein the at least one tooth cooperating with the set of teeth includes at least one tooth disposed on one of the two relatively movable parts of the tensioner mechanism for co-operating with and engaging a plurality of spaced teeth disposed on the other of the two relatively movable parts of the tensioner mechanism.

6. The device according to claim 3, wherein the button is pivotally mounted in another opening in one of the two relatively movable parts.

7. The device according to claim 1, including two buttons, the two buttons being actuated simultaneously toward one another in order to obtain unlocking of the two relatively movable parts.

8. The device according to claim 7, wherein the two buttons act on a first tooth cooperating with a first set of teeth and a second tooth cooperating with a second set of teeth provided on opposite sides of the two relatively movable parts.

9. The device of claim 1 wherein a first of the two relatively movable parts is movable within a second of the two relatively movable parts, the button is mounted to the second of the two relatively movable parts that can be manually moved in the second actuation direction to engage the first of the two relatively movable parts.

10. A closure or solar protection installation comprising an actuator device designed for actuating a release member for a motor and gearbox unit for applying rotary drive to a tube for winding a screen of the closure or solar protection installation, the release member being controlled by a cable, the actuator device including a tensioner mechanism for tensioning the cable by an action on two relatively movable parts of the tensioner mechanism along a first actuation direction and wherein the two relatively movable parts of the tensioner mechanism form a deformable handle of a size and configuration to be operatively manipulated in a person's hand by being moved relative to one another along the first actuation direction in order to place tension on the cable in a direction different than the first actuation direction, at least one tooth cooperating with one set of teeth for locking the two relatively movable parts of the tensioner mechanism to one another to retain tension on the cable, at least one button for unlocking the two relatively movable parts of the tensioner mechanism, wherein the button is mounted to one of the two relatively movable parts and is manually movable along a second actuation direction which is substantially perpendicular to the first actuation direction to thereby force the at least one tooth carried by one of the two relatively movable parts to be released from a the set of teeth carried by another of the two relatively movable parts and to uncouple the motor from the tube for winding the screen, and wherein one of the two relatively movable parts of the tensioner mechanism includes an opening and marks on the other of the two relatively movable parts viewable through the opening for identifying a relative position between the two relatively movable parts.

11. The closure or solar protection installation according to claim 10, wherein one of the two relatively movable parts is mounted within a portion of the other of the two relatively movable parts and the button is mounted to the other of the two relatively movable parts.

12. The closure or solar protection installation according to claim 10, wherein the two relatively movable parts of the tensioner mechanism are pivotally mounted to one another.

13. The closure or solar protection installation according to claim 10, wherein the cable is fastened to one of the two relatively movable parts, and a sheath of the cable bears against a second of the two relatively movable parts, and the at least one tooth cooperating with one set of teeth blocks a degree of freedom of movement between the two relatively movable parts.

14. The closure or solar protection installation according to claim 13, wherein the first and second relatively movable parts are mounted to pivot relative to one another.

15. The closure or solar protection installation according to claim 13, wherein the at least one tooth cooperating with one set of teeth includes at least one tooth disposed on one of the two relatively movable parts of the tensioner mechanism for co-operating with a plurality of teeth disposed on the other of the two relatively movable parts of the tensioner mechanism.

16. The closure or solar protection installation according to claim 11, wherein the button is pivotally mounted within an opening in one of two relatively movable parts.

17. The closure or solar protection installation according to claim 11, including two buttons, the two buttons being mounted to the other of the two relatively movable parts so as to be actuated simultaneously toward one another in order to obtain unlocking of the two relatively movable parts.

18. The closure or solar protection installation according to claim 17, wherein the two buttons act on the at least one tooth cooperating with the set of teeth and a second tooth cooperating with a second set of teeth provided along opposite sides of the two relatively movable parts.

19. The closure or solar protection installation according to claim 10, wherein a first of the two relatively movable parts is movable within a second of the two relatively movable parts, the button is mounted to the second of the two relatively movable parts that can be manually moved in the second actuation direction to engage the first of the two relatively movable parts.

* * * * *